US012133561B2

(12) United States Patent
Mott

(10) Patent No.: US 12,133,561 B2
(45) Date of Patent: Nov. 5, 2024

(54) NUDITY SUPPORT BRA

(71) Applicant: Deidre Mott, Killeen, TX (US)

(72) Inventor: Deidre Mott, Killeen, TX (US)

( * ) Notice: Subject to any disclaimer, the term of this patent is extended or adjusted under 35 U.S.C. 154(b) by 0 days.

(21) Appl. No.: 17/533,590

(22) Filed: Nov. 23, 2021

(65) Prior Publication Data

US 2022/0295908 A1 Sep. 22, 2022

Related U.S. Application Data

(60) Provisional application No. 63/163,098, filed on Mar. 19, 2021.

(51) Int. Cl.
*A41C 3/00* (2006.01)
*A41C 3/04* (2006.01)

(52) U.S. Cl.
CPC ..... *A41C 3/0021* (2013.01); *A41C 3/0028* (2013.01); *A41C 3/04* (2013.01)

(58) Field of Classification Search
None
See application file for complete search history.

(56) References Cited

U.S. PATENT DOCUMENTS 1,167,741 A * 1/1916 Clarke ..... A41C 3/10 602/61
2,505,720 A * 4/1950 Peiser et al. ..... A41C 3/124 128/889
2,793,369 A * 5/1957 Panighini ..... A41C 3/065 D2/706
2,897,821 A * 8/1959 Lerner ..... A41D 7/001 450/55
4,350,162 A * 9/1982 Kearton ..... A41C 3/10 450/86
4,602,191 A * 7/1986 Davila ..... G09F 21/02 315/316
5,113,325 A * 5/1992 Eisenbraun ..... G09F 21/02 362/800
5,797,786 A * 8/1998 Smith ..... A41C 3/0064 450/67
6,174,217 B1 * 1/2001 Judson ..... A41C 3/0042 450/7
6,206,752 B1 * 3/2001 Fagin ..... A41F 15/005 450/86

(Continued)

*Primary Examiner* — Jocelyn Bravo
(74) *Attorney, Agent, or Firm* — Brennan, Manna & Diamond, LLC

(57) ABSTRACT

The present invention relates to a nudity support bra that lifts the breasts of the wearer from the bottom and supports breasts from the sides without covering the breasts. The bra has a pair of C-shaped cups, each having a bottom edge that pushes the breast upwards, and a side edge that pushes the breast inwards. A separate halter neck strap is attached to the side edge of the C-shaped cups and is secured behind the neck of a user, in addition to a back strap having a clasp for securing around the back of the user. The innovation also includes a strapless and a sports wear design. The cups further support and shape the sides of the breasts from the undersides without covering the breasts, thereby allowing revealing clothing to function as designed, enabling women to nurse without removing their bra or a portion of their bra and supporting modern medical procedures of the breast.

15 Claims, 8 Drawing Sheets

(56) References Cited

U.S. PATENT DOCUMENTS

| | | | | |
|---|---|---|---|---|
| 8,469,769 | B2 * | 6/2013 | Hendrickson | A41F 15/002 450/33 |
| 8,690,635 | B1 * | 4/2014 | Calvert | A41C 3/0021 450/60 |
| 8,758,082 | B1 * | 6/2014 | Woods | A41C 3/04 450/86 |
| 2001/0027079 | A1 * | 10/2001 | Valentin | A41C 3/065 450/41 |
| 2005/0255790 | A1 * | 11/2005 | Cassity | A41C 3/0021 450/88 |
| 2008/0198578 | A1 * | 8/2008 | Finn | A41C 3/00 362/276 |
| 2009/0221942 | A1 * | 9/2009 | Shian | A41C 3/005 450/1 |
| 2010/0068971 | A1 * | 3/2010 | Hendrickson | A41C 3/04 2/104 |
| 2010/0154472 | A1 * | 6/2010 | Unitan | A44C 15/0045 63/23 |
| 2011/0030128 | A1 * | 2/2011 | Buettner | A41B 9/002 2/406 |
| 2011/0081826 | A1 * | 4/2011 | Hendrickson | A41C 3/0028 450/39 |
| 2015/0204534 | A1 * | 7/2015 | Finn | A41B 9/04 362/103 |
| 2018/0103692 | A1 * | 4/2018 | Dowdle | A41D 7/00 |
| 2020/0054079 | A1 * | 2/2020 | Rutkoski | A41F 1/006 |
| 2021/0337885 | A1 * | 11/2021 | Connor | A41C 3/0064 |
| 2023/0049200 | A1 * | 2/2023 | Muhlenfeld | A41C 3/0057 |

* cited by examiner

NUDITY SUPPORT BRA

CROSS-REFERENCE TO RELATED APPLICATION

The present application claims priority to, and the benefit of, U.S. Provisional Application No. 63/163,098, which was filed on Mar. 19, 2021, and is incorporated herein by reference in its entirety.

FIELD OF THE INVENTION

The present invention relates generally to the field of brassieres. More specifically, the present invention relates to a nudity support bra that lifts the breasts of the wearer from the bottom, and supports breasts from the sides without covering the breasts. The bra has a pair of C-shaped cups, each having a bottom edge that pushes the breast upwards and a side edge that pushes the breast inwards. A separate halter neck strap is attached to the side edge of the C-shaped cups and is secured behind the neck of a user, in addition to a back strap having a clasp for securing around the back of the user. The cups further support and shape the sides of the breasts from the undersides without covering the breasts, thereby allowing revealing clothing to function as designed, enabling women to nurse without removing their bra or a portion of their bra and supporting modern medical procedures of the breast. Accordingly, this disclosure makes specific reference thereto the present invention. Nonetheless, it is to be appreciated that aspects of the present invention are also equally applicable to other like applications, devices and methods of manufacture.

BACKGROUND OF THE INVENTION

By way of background, a brassiere, or hereafter referred to as a bra, is an article of clothing that supports, covers and elevates the breasts or mammary glands of the female wearer. Women wear bras for a variety of purposes such as to support their breasts, to improve the shape of their breasts, to reduce or to enlarge their perceived breast size, to restrain breast movement during an activity such as exercise, to enhance their cleavage or to facilitate nursing. Further, bra designers strive to produce a garment that is both functional and aesthetically pleasing.

However, bra designs have barely changed since their inception, even with significant changes in fashion, culture and technology occurring elsewhere. Today, fashionable clothing for women often includes low-cut/plunging necklines and revealing or transparent designs. However, traditionally designed bras do not support these new fashion designs. Such failures may cause women to struggle with self-image and confidence, and are also simply undesirable. Further, the social culture has changed such that nursing in public locations has become more acceptable, yet current bra designs are not conducive to this activity. In addition, medical procedures that involve measurements of the breast or reconstruction of the breast can be hindered with current bra designs. As a result, a new bra design is needed for the current fashion, culture and technology of this day and age.

The U.S. has an obesity epidemic. The average weight of Americans has been increasing for decades. As BMI and waist lines have increased, women's breast sizes have also increased. The bra of the present invention takes into account the need for comfortable support for large, mature, multiparous nude breasts that is long overdue.

One attempt to address the long-felt need for a bra that functions with modern fashion designs is the push-up adhesive bra. However, this bra covers the breasts of the wearer but does not look aesthetically appealing when worn nude or under transparent or revealing dresses, tank tops, camisoles, lingerie, etc. Further, it is common for the breast to overflow the bottom or outside edge of the push-up adhesive bra, wherein both situations can lead to discomfort and embarrassment. Also, adhesive bras do not adhere well in general and are virtually worthless for active wearers due to increased perspiration by the wearer. And, they are totally impractical to use with swimwear. The bra of the present invention can be used to support nudity in swimwear, and a utilitarian version can be designed for sportswear.

In addition to the long-felt need for a new bra to support modern fashion designs, there is also a long-felt need for a new bra to support nursing women. As modern cultures reembrace nursing, the number of nursing women has increased. When women need to nurse a child, the traditional bra design requires them to remove the lining of the bra that covers the breasts. This can be problematic and troublesome, as material needs to be removed which may be difficult and may destroy the functional structure of the bra. Additionally, breast nipples are sometimes very sensitive, sore, irritated, crusted, or cracked due to suckling. Current bra designs add to the discomforts experienced by nursing moms.

There is also a long-felt need for a new bra to support modern medical procedures. For example, a bra that exposes the breast is needed to obtain accurate measurements for mastopexy procedures. Reconstructive surgeries that may take place after a mastectomy may also benefit from a bra that does not cover the breast. Any medical treatment that may benefit from exposing the breast would be aided by a new bra design that exposes the breast while still supporting the breast.

Therefore, there exists a long-felt need in the art for an improved bra that that supports, lifts, shapes and fully exposes the breasts for use with transparent or revealing dresses, tank tops, camisoles, lingerie, etc., while being easy and comfortable to use. There also exists a long-felt need in the art for a bra that instills confidence in the user when wearing revealing clothing or while nude. Furthermore, there is a long-felt need in the art for a bra that allows breastfeeding women to feed a nursing child without having to remove the lining of a bra that typically covers their breasts, or destroying the function of the bra by doing so. Further, there is a long-felt need in the art for a bra that exposes the breast while still supporting the breast for a number of medical-related procedures.

The subject matter disclosed and claimed herein, in one embodiment thereof, comprises a nudity support bra. The bra of is comprised of a new bra design that lifts the breasts of the wearer from the bottom and supports breasts from the sides without covering the breasts. The nudity support bra has a pair of C-shaped cups, each C-shaped cup having a bottom edge and a side edge. The side edge pushes the breast inwards, and the bottom edge pushes the breast upwards. A separate halter neck strap is attached to the side edge of the C-shaped cups, wherein the halter-neck straps are secured behind the neck of a user. There is also a back strap having a clasp for securing around the back of the user. The C-shaped cups further support and shape the sides of the breasts from the undersides without covering the breasts, thereby allowing revealing clothing to function as designed, enabling women to nurse without removing their bra or a portion of their bra and supporting modern medical procedures of the breast.

In this manner, the nudity support bra of the present invention meets all the forgoing long-felt needs and provides support while improving perceived breast shape, breast size and breast cleavage needed for modern revealing clothing designs, while also allowing women to nurse their infants without removing or destroying their bra. The bra meets these long-felt needs by eliminating any lining or covering of the breast while offering support from a firm and padded surfaces underneath and alongside the breast. The nudity support bra also benefits a number of medical procedures which require the breasts to be both supported and exposed. The nudity support bra is also easy to use as it is worn like a conventional bra.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a nudity support bra that is configured to lift the breasts of the wearer without covering the breasts. The nudity support bra is comprised of a pair of C-shaped cups, wherein each C-shaped cup has a bottom edge that pushes the breast upwards and a side edge that pushes the breast inwards. A separate halter neck strap is attached to the side edge of the C-shaped cups and is secured behind the neck of a user. There is also a back strap having a clasp to secure the bra at the back of the user. The C-shaped cups further support the breasts from the underside and provide shape along the side of the breasts without covering the breasts. As is common for fashionable undergarments, the nudity support bra may be made of an edible fabric that becomes pliable and flavorful at normal body temperature.

In a further embodiment of the present invention, a bra for wearing under revealing dresses, tank tops, camisoles, lingerie, etc. is disclosed. The bra is designed to expose the breasts of the wearer while simultaneously lifting the breasts. The bra includes two C-shaped cups connected through a connector, each C-shaped cup having a side edge to push the breast inwards and a bottom edge to lift the breast, a detachable piece applied over the connector using an eye and hook closure for providing the desired separation in the cleavage, a pair of straps for holding the brassiere over the shoulders and a back strap for holding the brassiere around the back of a wearer.

The nudity support bra also has medical applications. In medical-related embodiment of the present invention, the nudity support bra has transparent C-shaped cups and can be used in mastopexy for accurately measuring the amount of lift needed for the breasts. In another medial embodiment, the C-shaped cups can be made up of a medical grade or medicated fabric for healing and reducing friction on affected areas of the breast. These medical applications are in addition to the long-felt needs in fashion design and breast-feeding.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are not intended to include all such aspects and their equivalents. Other advantages and novel features will become apparent from the following detailed description when considered in conjunction with the drawings.

BRIEF DESCRIPTION OF THE DRAWINGS

The description refers to provided drawings in which like reference numerals refer to like parts throughout the different views, and in which.

DETAILED DESCRIPTION OF THE PRESENT INVENTION

Figure 1:
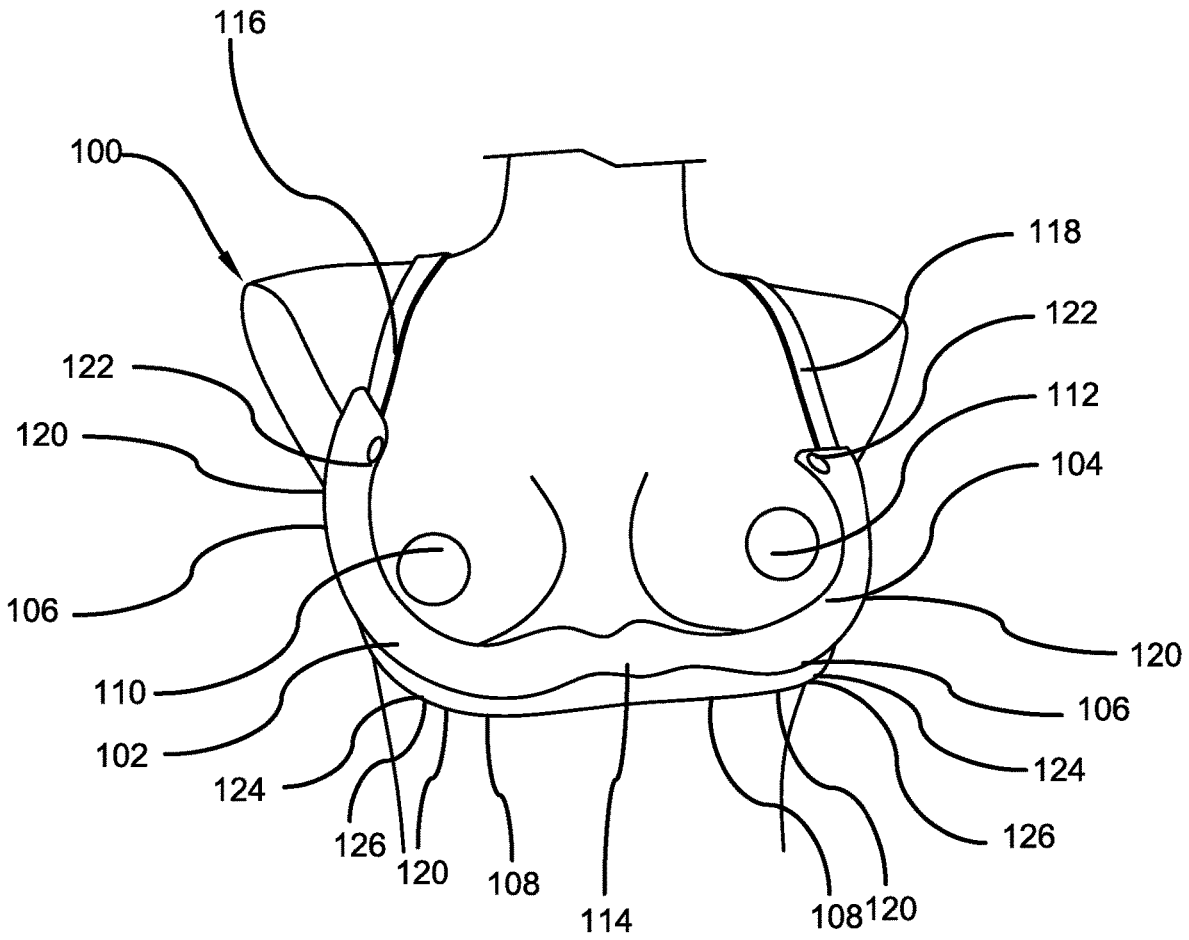
FIG. 1 illustrates a front perspective view of one potential embodiment of the nudity support bra of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a bra that is suitable for wearing under transparent or revealing dresses, tank tops, camisoles, lingerie, etc., and that lifts the breasts of the wearer without covering the breasts. Further, there exists a long-felt need in the art for a bra that allows full exposure of both breasts while supporting and shaping the breasts such that it instills confidence in a user that is wearing revealing clothing or is nude. Furthermore, there is a long-felt need in the art for a bra that allows breastfeeding women to feed without having to remove their bra or the portion of their bra that covers the breast. There is also a long-felt needs for a bra that supports medical procedures involving the breast.

The present invention, in one exemplary embodiment, is comprised of a nudity support bra that does not cover the breasts, while lifting the breasts from the bottom and supporting the breasts from the sides. The bra includes two C-shaped cups connected through a connector, each C-shaped cup having a side edge to push the breast inwards and a bottom edge to lift the breast, a detachable piece applied over the connector using an eye and hook closure for providing the desired separation in the cleavage, a pair of straps for holding the bra over the shoulders or around the neck and a back strap for holding the brassiere around the back of a wearer.

Referring initially to the drawings, FIG. 1 illustrates a front perspective view of one potential embodiment of the nudity support bra of the present invention in accordance with the disclosed architecture. The nudity support bra 100 is designed to support the breasts while nude or wearing revealing clothing. More specifically, the nudity support bra 100 shapes and supports both breasts from the side and underneath while allowing full exposure of both breasts.

The nudity support bra 100 has a first C-shaped cup 102 and a second C-shaped cup 104 made up of a firm and padded textile, such as but not limited to silicone rubber. The material of the improved bra 100 is also preferably a hypoallergenic, pressure sensitive and non-toxic material that reduces irritation of the skin. The nudity support bra 100 can be made in all sizes and colors as are other bras, and can be made of all materials that those skilled in the art of bra design and manufacture would use. As with other undergarments, the nudity support bra 100 can be made of an edible material.

Both the C-shaped cups 102, 104 have an interior concave and an exterior convex shape. Both the first C-shaped cup 102 and the second C-shaped cup 104 are also defined by a curved side edge 106 and a curved bottom edge 108. The first C-shaped cup 102 is designed to extend along the side and underneath the first breast/mammary gland 110 of a user, such that the first mammary gland 110 rests atop of the first C-shaped cup 102. Similarly, the second C-shaped cup 104 is designed to extend along the side and underneath the second breast/mammary gland 112 of the user such that the second mammary gland 112 rests atop of the second C-shaped cup 104. The C-shaped cups 102, 104 are designed such that the textile material does not cover the breasts but supports, shapes and lifts the breasts from underneath and the along the sides. The side edges 106 push the breasts 110, 112 inwards and the bottom edges 108 push the breasts 110, 112 upwards, thereby allowing full exposure of both breasts 110, 112 while maintaining support and providing the required shape and cleavage.

The first C-shaped cup 102 and the second C-shaped cup 104 are connected to each other through a connector bridge 114. The connector bridge 114 extends along the curved bottom edge 108 of the first C-shaped cup 102 and the second C-shaped cup 104 along the bottom line of the breasts 110, 112. The connector 114 is a permanent connector and allows the cups 102, 104 to conform to the breasts 110, 112.

The present embodiment of the nudity support bra 100 has a first halter neck strap 116 extending from the side edge 106 of the first C-shaped cup 102 and a second halter neck strap 118 extending from the side edge 106 of the second C-shaped cup 104. Both the halter neck straps 116, 118 are secured behind the neck of the user for a secure fit of the bra 100. Further, the padded C-shaped cups 102, 104 of the bra 100 supporting the mammary glands 110, 112 cover a portion (preferably 50%-60%, but not limited to any specific amount) of the underside of the mammary glands 110, 112, while exposing the upper portion of the mammary glands 110, 112. The side edges 106 are also no thicker than 4 mm in the preferred embodiment and the bottom edges 108 may not be thicker than 5 mm in the preferred embodiment. However, differing embodiments of the bra 100 may have various components of various thicknesses.

The padding of the C-shaped cups 102, 104 is thickest along the bottom edge 108 just below the breasts 102, 104. Further, the bottom edges 108 and the side edges 106 work together to provide support for the breasts 102, 104 and to create a superior bust line and cleavage appearance. The bra 100 may also include optical fibers 120 of a variety of colors embedded just below the surface of the bottom edges 108 and the side edges 106 to accent the breasts. A light 122 can be incorporated into the upper portion of each of the side edges 106 to illuminate the exposed breasts. The optical fibers 120 and the lights 122 can be powered by a built-in battery 124 located within the thickest portions of the bottom edges 108 and activated with a built-in switch 126.

Figure 2:
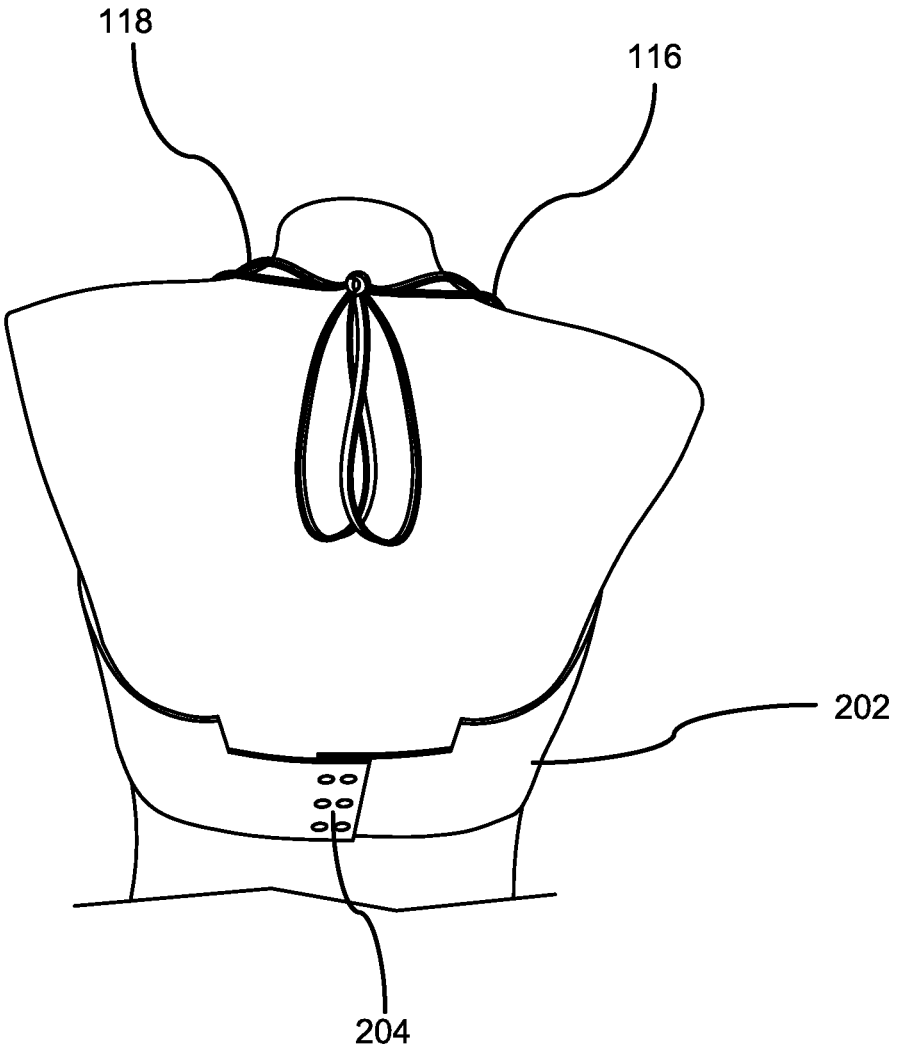
FIG. 2 illustrates a rear perspective view of one potential embodiment of the nudity support bra of the present invention in accordance with the disclosed architecture.

FIG. 2 illustrates a rear perspective view of one potential embodiment of the nudity support bra of the present invention in accordance with the disclosed architecture. In the present embodiment, halter neck straps 116, 118 are used for securing the bra 100, wherein the straps 116, 118 and are tied behind the neck of the wearer. Further, a back strap 202 with hooks or clasps 204 is used to secure the bra 100 around the back of the wearer. It should be appreciated that any other means, such as but not limited to: an adhesive strip or a hook and loop fastener/VELCRO can be used for fastening the back strap 202.

The nudity support bra 100 can also be used for medical procedures. It should be appreciated that the improved bra 100 can be used by a surgeon for performing mastopexy and more specifically for obtaining exact measurements of the breasts for the mastopexy process. For a mastopexy, the improved bra 100 can be made up of a transparent material, such as a transparent plastic, so that the entire breast is visible without obstruction, thereby allowing accurate measurements of the lift needed for the mastopexy. This measurement can be used by the surgeon during the mastopexy process. The nudity support bra 100 can also be used during recovery from breast cancer treatment. Often, women experience extreme skin sloughing underneath the breasts as a consequence of radiation treatments. To alleviate sloughing, the mammary glands 110, 112 can be lifted and secured in a manner that minimizes contact of the breasts with thoracic tissue. For such cases, the nudity support bra 100 can be made up of a medical grade and/or medicated type of fabric to support healing and reduce friction on the affected areas.

Figure 3:
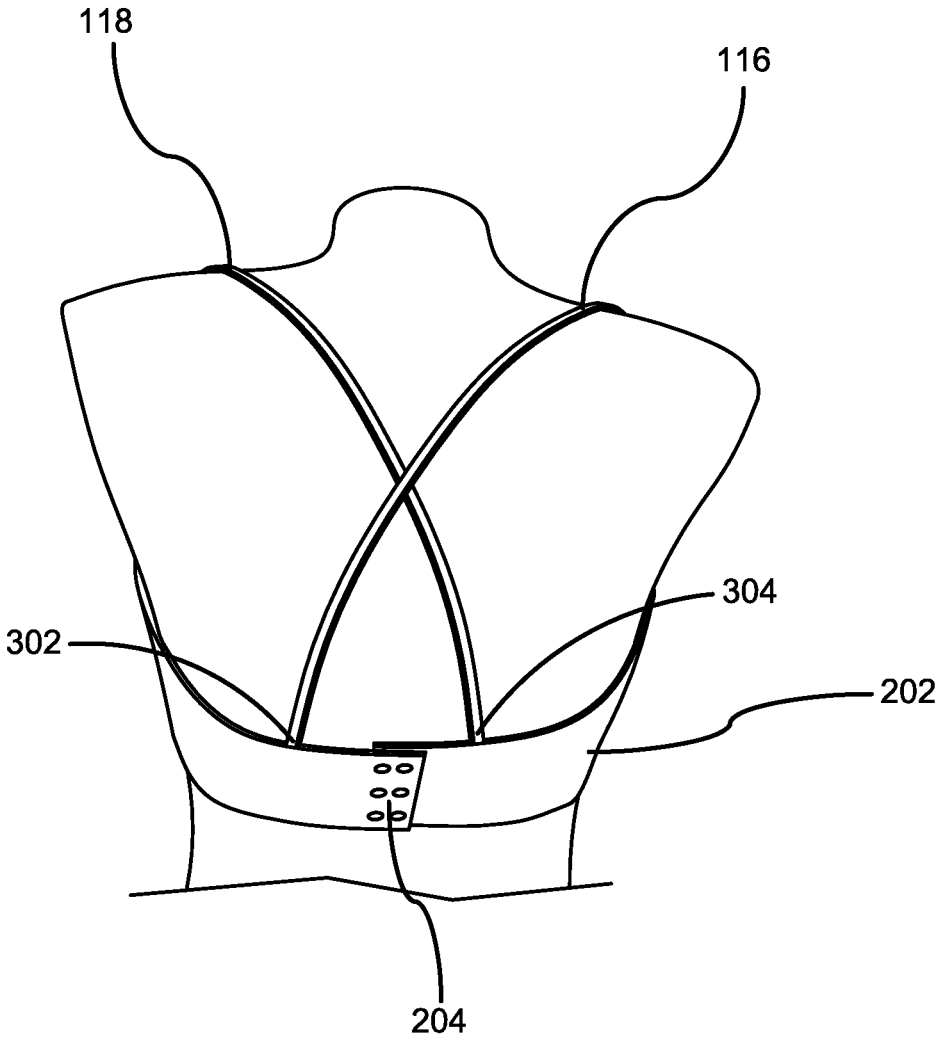
FIG. 3 illustrates a rear perspective view of rear view of another potential embodiment of the nudity support bra of the present invention in accordance with the disclosed architecture.

FIG. 3 illustrates a rear perspective view of one embodiment of the nudity support bra 100 of the present invention in accordance with the disclosed architecture. In the present embodiment, the halter neck straps 116, 118 are attached to the back strap 202. More specifically, the first halter neck strap 116 is detachably-attached to the back strap 202 using a first clip 302, and the second halter neck strap 118 is detachably-attached to the back strap 202 using a second clip 304.

Figure 4:
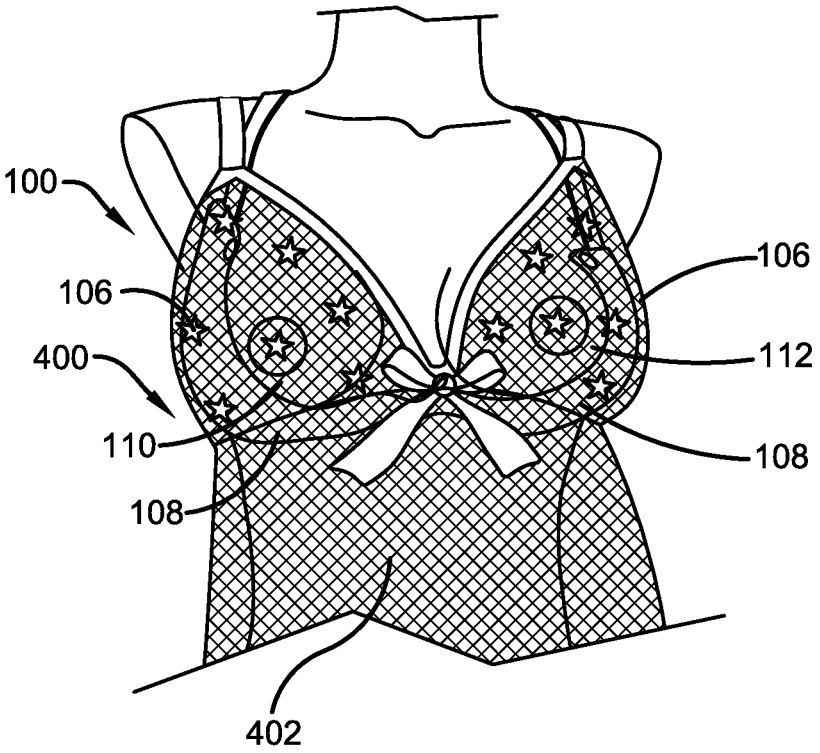
FIG. 4 illustrates a perspective showing a user wearing the nudity support bra of the present invention under a revealing dress (shown as prior art) in accordance with the disclosed architecture.

FIG. 4 illustrates a perspective view showing a user 400 wearing the nudity support bra of the present invention under a revealing dress 402 (shown as prior art) in accordance with the disclosed architecture. When a user 400 wears a revealing dress 402 and wants to expose their breasts 110, 112, the user 400 can wear the nudity support bra 100 with side edges 106 pushing the breasts inwards and the bottom edges 108 lifting the breasts from the bottom. The nudity support bra 100 therefore allows the user 400 to appear as if the user is not wearing a bra while the breasts 110, 112 remain lifted and shaped.

Figure 5:
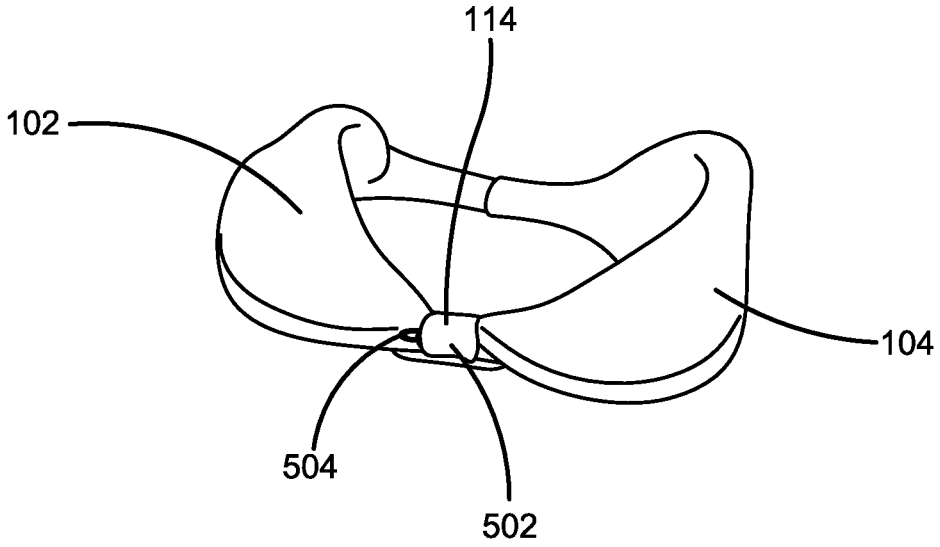
FIG. 5 illustrates a perspective view showing attachment of a removable piece to the connector of the nudity support bra of the present invention in accordance with the disclosed architecture.

FIG. 5 illustrates a perspective view showing attachment of a removable piece 502 to the connector of the nudity support bra 100 of the present invention in accordance with the disclosed architecture. In the preferred embodiment, a removable piece 502 is designed to be placed in the wearer's cleavage to provide separation of the breasts 110, 112. The removable piece 502 can be made of a soft, pliable plastic allowing the wearer to determine the amount of separation between the breasts according to her attire. The separation is obtained by increasing or decreasing the distance between the two-halves of the soft, pliable, plastic material that rests in the cleavage. This piece 502 can be attached by folding the removable piece 502 over the connector 114 connecting the bra cups 102, 104. The folds of the piece 502 remain secure by use of an any fastener known in the art, but preferably a hook and eye closure 504.

Figure 6:
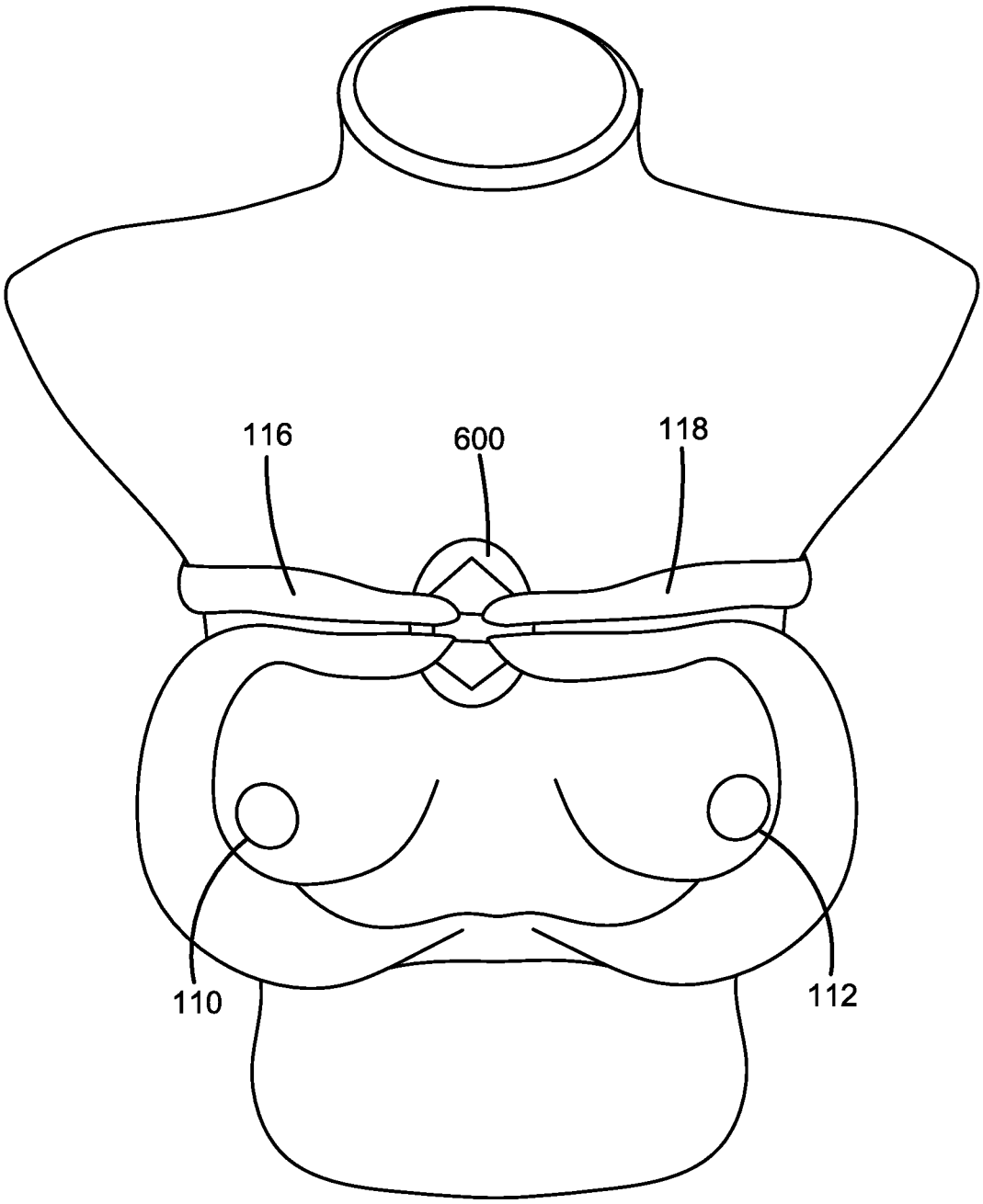
FIG. 6 illustrates a front perspective view of one potential strapless embodiment of the nudity support bra of the present invention in accordance with the disclosed architecture.

FIG. 6 illustrates a front perspective view of one potential strapless embodiment of the nudity support bra 100 of the present invention in accordance with the disclosed architecture. In another embodiment of the present invention, the bra device 100 may be strapless such that it can be worn with tube tops, etc., and may be held in place by fastening the straps 116,118 laterally across the chest to an oval hooked plastic connector 600 (e.g. buckle) or other type of suitable fastener such that the device 100 encloses the breasts 110,112 of the user in a circular/ovular fashion.

Figure 7A:
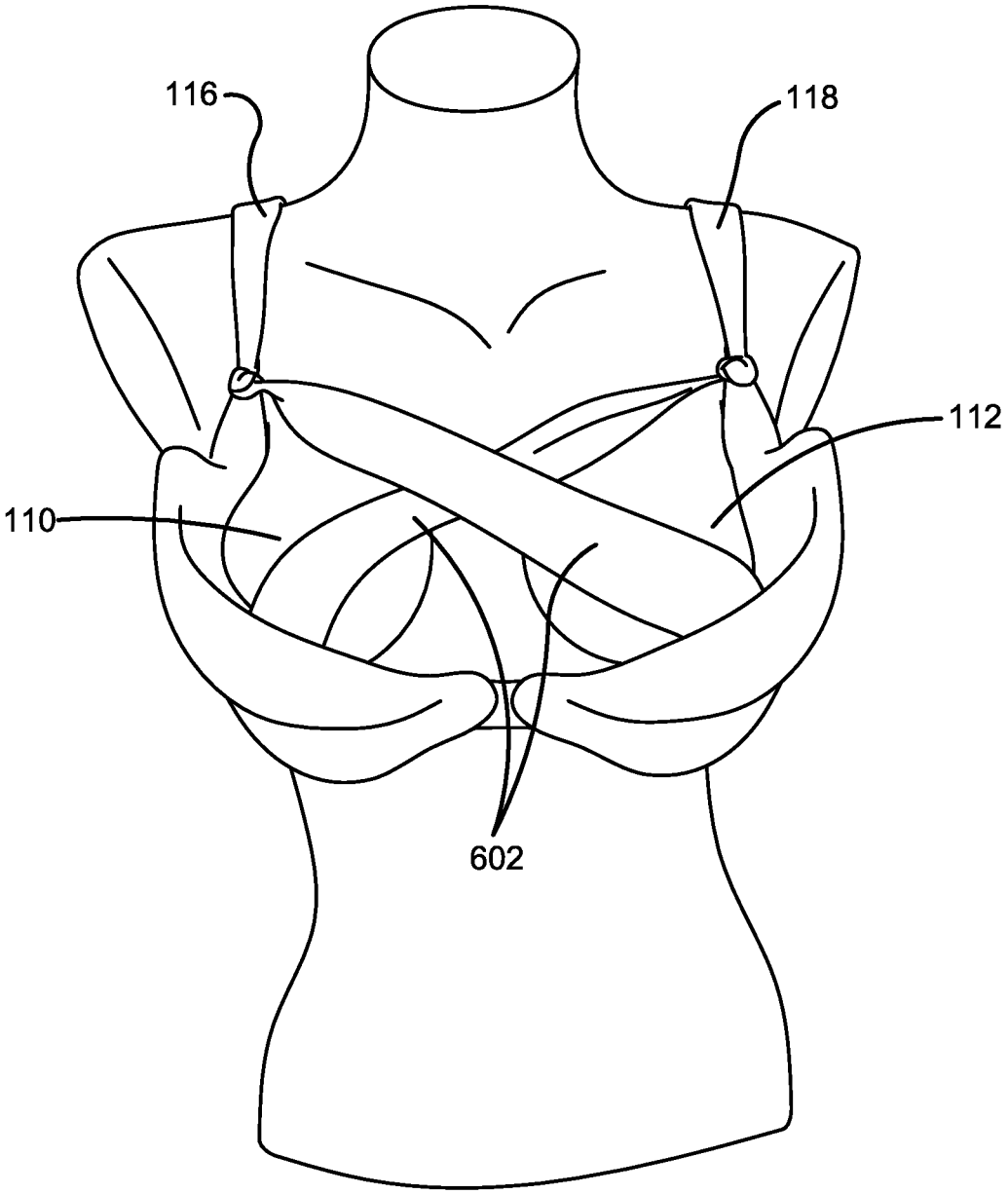
FIG. 7A illustrates a front perspective view of one potential active embodiment of the nudity support bra of the present invention in accordance with the disclosed architecture.
Figure 7B:
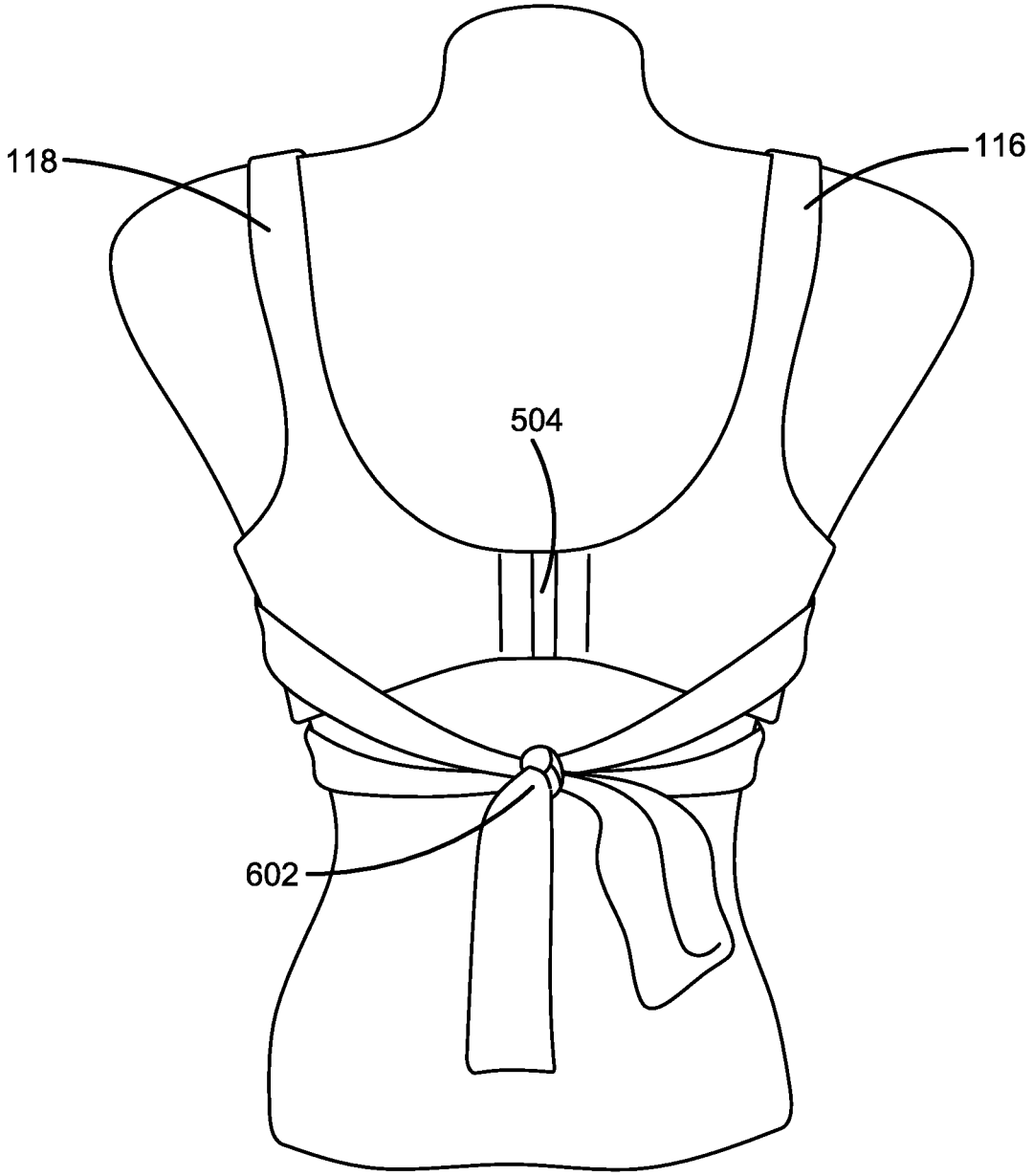
FIG. 7B illustrates a rear perspective view of one potential active embodiment of the nudity support bra of the present invention in accordance with the disclosed architecture.

FIGS. 7A and 7B illustrates a front and rear perspective view of one potential active embodiment of the nudity support bra 100 of the present invention in accordance with the disclosed architecture. In yet another embodiment of the present invention, the bra device 100 may be of an active design or a sports bra. The active woman desires to have her breasts securely attached to the thoracic wall during sports or other active moments. This can be done with this innovative design by fashioning straps 602 that go across the anterior aspect of the chest (vertically, horizontally, or crisscross). The straps 602 could then be secured, compressing the breasts 110,112 to the thoracic wall by tying the straps 602 in the back or using connectors 114 and/or hook and eye closures 504 to secure the compression straps 602 to the support padding or other areas on the bra 100.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "nudity support bra", "support bra", "bra", and "brassiere" are interchangeable and refer to the nudity support bra 100 of the present invention.

Notwithstanding the forgoing, the nudity support bra 100 of the present invention can be of any suitable size and configuration as is known in the art without affecting the overall concept of the invention, provided that it accomplishes the above-stated objectives. One of ordinary skill in the art will appreciate that the size, configuration, and material of the nudity support bra 100 as shown in the FIGS. are for illustrative purposes only, and that many other sizes and shapes of the nudity support bra 100 are well within the scope of the present disclosure. Although the dimensions of the nudity support bra 100 are important design parameters for user convenience, the nudity support bra 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A nudity support bra comprising:

a set of C-shaped cups each configured to reveal a breast of a wearer, wherein the set of C-shaped cups is comprised of a first cup and a second cup that each have a bottom edge configured to push the wearer's breast up, and a side edge configured to push the wearer's breasts towards each other;

a connector configured to join the first cup and the second cup together;

a set of halter neck straps comprised of a first halter neck strap and a second halter neck strap, wherein the first halter neck strap is attached to the side edge of the first cup, and the second halter neck strap is attached to the side edge of the second cup;

a set of back straps comprised of a first back strap and a second back strap, wherein the first back strap is attached to the side edge of the first cup and the second back is attached to the side edge of the second cup;

a clasp that detachably connects the set of back straps together;

a removable plastic separator positioned over the connector and securable in place via a hook and eye closure, wherein the removable plastic separator is configured to fold over the connector and to provide adjustable separation of the wearer's breasts; and wherein the first halter neck strap and the second halter neck strap are detachably attachable to the respective first and second back straps via a pair of clips; and wherein the bottom edge and the side edge of each cup comprise at least one optical fiber.

2. The nudity support bra of claim 1, wherein each cup of the set of C-shaped cups is comprised of an interior shape and an exterior shape, the interior shape being concave and the exterior shape being convex.

3. The nudity support bra of claim 1 further comprising at least one battery built into the bottom edge of at least one of the first and second cups.

4. The nudity support bra of claim 1, wherein the nudity support bra is comprised of a rubber or a silicone.

5. The nudity support bra of claim 1, wherein the nudity support bra is comprised of a material that is hypoallergenic, pressure sensitive and non-toxic.

6. The nudity support bra of claim 1, wherein the nudity support bra is comprised of a material that is edible.

7. A nudity support bra that supports a wearer while nursing, the nudity support bra comprising:

a set of C-shaped cups each configured to reveal a breast of a wearer, wherein the set of C-shaped cups is comprised of a first cup and a second cup each having a bottom edge configured to push the breasts of the wearer up and a side edge configured to push the breast of the wearer towards each other;

a connector configured to join the first cup and the second cup together;

a set of halter neck straps comprised of a first halter neck strap and a second halter neck strap, wherein the first halter neck strap is attached to the side edge of the first cup, and the second halter neck strap is attached to the side edge of the second cup;

a set of back straps comprised of a first back strap and a second back strap, wherein the first back strap is attached to the side edge of the first cup and the second back strap is attached to the side edge of the second cup;

a clasp that detachably connects the two back straps together; and a removable plastic separator positioned over the connector and securable in place via a hook and eye closure, wherein the removable plastic separator is configured to fold over the connector and to provide adjustable separation of the wearer's breasts; and wherein the bottom edge and the side edge of each cup comprise at least one optical fiber.

8. The nudity support bra of claim 7, wherein each cup of the set of C-shaped cups is comprised of an interior shape and an exterior shape, the interior shape being concave and the exterior shape being convex.

9. The nudity support bra of claim 7, wherein the set of back straps are further comprised of a first clip and second clip, wherein the first clip is attached to the first back strap and is configured to connect to the first halter strap and the second clip is attached to the second back strap and is configured to connect to the second halter strap.

10. The nudity support bra of claim 9, wherein the nudity support bra is comprised of a padded textile material.

11. The nudity support bra of claim 9, wherein the nudity support bra is comprised of a material that is hypoallergenic, pressure sensitive, and non-toxic.

12. A nudity support bra that can be worn following a breast-related medical procedure, the nudity support bra comprising:

a set of C-shaped cups each configured to reveal a breast of a wearer, wherein the set of C-shaped cups is comprised of a first cup and a second cup each having a bottom edge configured to push the breasts of the wearer up and a side edge configured to push the breast of the wearer towards each other;

a connector configured to join the first cup and the second cup together;

a set of halter neck straps comprised of a first halter neck strap and a second halter neck strap, wherein the first halter neck strap is attached to the side edge of the first cup, and the second halter neck strap is attached to the side edge of the second cup;

a set of back straps comprised of a first back strap and a second back strap, wherein the first back strap is attached to the side edge of the first cup and the second back strap is attached to the side edge of the second cup;

a clasp that detachably connects the first and second back straps together;

a plurality of optical fibers embedded below a surface of the bottom edges and the side edges of each C-shaped cup;

a light incorporated into an upper portion of each C-shaped cup;

a battery built into the bottom edge of one of the C-shaped cups; and a switch built into the nudity support bra in electrical communication with and configured to control the plurality of optical fibers and the light.

13. The nudity support bra of claim 12, wherein each cup of the set of C-shaped cups is comprised of an interior shape and an exterior shape, the interior shape being concave and the exterior shape being convex.

14. The nudity support bra of claim 12, wherein the nudity support bra is comprised of a transparent material.

15. The nudity support bra of claim 12, wherein the nudity support bra is comprised of a medical grade material that is medicated.

* * * * *